United States Patent [19]

Grush, Jr.

[11] Patent Number: 4,477,943

[45] Date of Patent: Oct. 23, 1984

[54] BIVALVE SHELLFISH OPENING KNIFE

[76] Inventor: Robert J. Grush, Jr., 3015 19th St., Metairie, La. 70002

[21] Appl. No.: 497,294

[22] Filed: May 23, 1983

[51] Int. Cl.[3] ..... A22C 29/04; A47G 21/06

[52] U.S. Cl. ..... 17/75; 30/287; 30/340

[58] Field of Search ..... 17/74, 75, 76; 30/287, 30/353, 356, 340

[56] References Cited

U.S. PATENT DOCUMENTS 903,055 11/1908 Chancey ..... 17/76

3,991,466 11/1976 Smith ..... 17/75 X

FOREIGN PATENT DOCUMENTS 10376 11/1932 Australia ..... 17/74

584948 11/1924 France ..... 17/75

*Primary Examiner*—Willie G. Abercrombie

*Attorney, Agent, or Firm*—James B. Lake, Jr.

[57] ABSTRACT

A bivalve shell opening blade is fixed by an end to a handle and has a pointed, oppositely disposed free end extending forwardly therefrom. The blade is angularly disposed to the handle so as to fall in aligned continuation of the user's forearm when grasping the handle with free pointed end forward. The blade is offset from the handle for increasing hand leverage in opening the bivalve shells, and the angular disposition of the blade in alignment with the forearm maximizes blade point insertion force between shells and minimizes hand to handle friction and reduce muscular fatigue and blisters in use.

3 Claims, 4 Drawing Figures

BIVALVE SHELLFISH OPENING KNIFE

BACKGROUND OF THE INVENTION

The invention relates generally to the opening of bivalve shellfish, and more particularly to an improved opening knife with blade offset from handle and angularly disposed thereto.

The prior art discloses bivalve shellfish openers Huppman, U.S. Pat. No. 411,381 and Arthur, U.S. Pat. No. 1,352,108 that teach a sharp blade in combination with a hammer, both being mounted in longitudinal continuation to a handle end; Lum and Sanford, U.S. Pat. No. 177,138 that teaches pincers with jaws to break open or break away shell edges, and a sharp blade mounted in longitudinal extension of a free end of one of the pincer jaws to cut the shellfish free of shells broken open by the jaws; and Coangelo, U.S. Pat. No. 2,854,688 that teaches a shell punch fixed in one end of a handle and a hook shaped blade fixed in the other handle end. In all of these, bivalve shells are broken to admit a sharp blade for cutting shells free of shellfish thereby introducing shell fragments into the shellfish.

The invention teaches a two edged pointed blade offset from a handle for increasing leverage in forcing apart shells, and angularly disposed thereto for the blade to be in the alignment with the forearm of a user, when the handle is normally grasped, for ease of insertion of blade between bivalve shells with no component of inserting force normal thereto to increase hand to handle friction and tire and blister operator's hand.

SUMMARY OF THE INVENTION

It is an object of the invention to provide an improved bivalve shellfish opening knife having a blade angularly offset from the handle and also, in the same plane, offset linearly therefrom for ease in opening said bivalve shellfish with less force and consequent tiring of the operator.

DETAILED DESCRIPTION OF THE PREFERRED EMBODIMENTS

Figure 1:
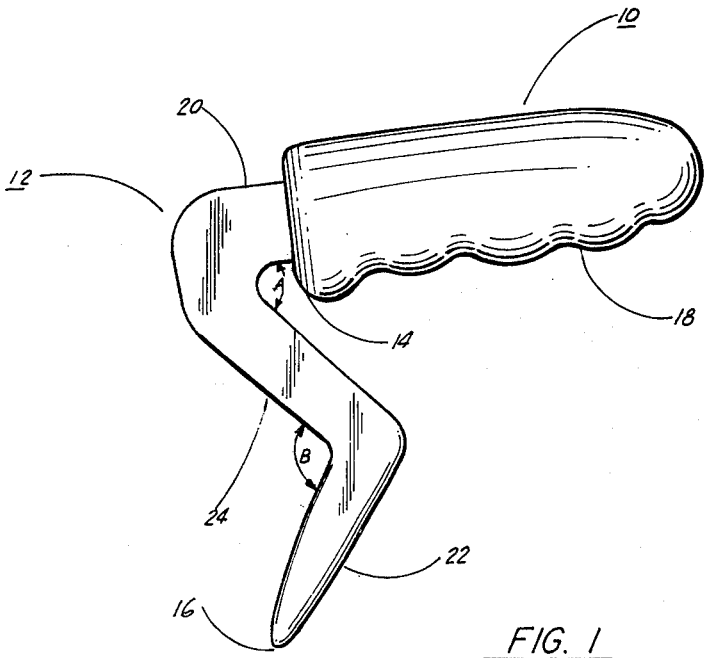
FIG. 1 is a side elevation of a first embodiment of the invention.
Figure 2:
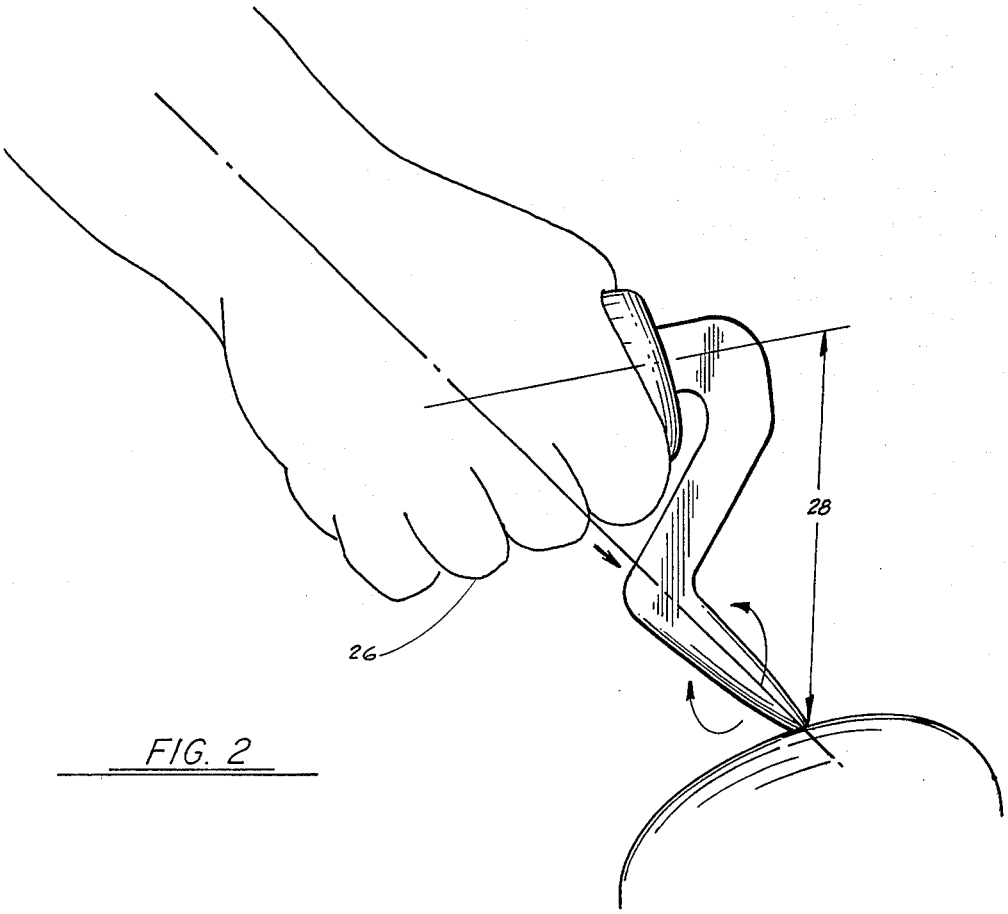
FIG. 2 is a side elevation of said first embodiment in use.

Referring to FIGS. 1 and 2, a first embodiment of the invention comprises a longitudinally held knife handle 10, and an inverted roughly "Z" shaped blade 12 mounted in the forward end 14 of handle 10 with a free point 16 of said blade extending essentially downwardly and forwardly.

Handle 10 is elongated for being grasped with hand and fingers 26, and with finger depressions defined in the lower handle surface for better and more comfortable gripping.

Blade 12 comprises upper and lower portions 20 and 22, respectively, that are vertically displaced from each other by a connecting part 24. The rear end of upper portion 20 is fixed in the forward end of handle 10 with connecting part 24 extending downwardly and rearwardly from the forward end of upper portion 20, and lower portion 22 extending, from the lower end of said connecting portion, forwardly and downwardly for the forearm, wrist and hand of an operator grasping handle 10 to be in alignment with lower portion 22 (see FIG. 2). Lower portion 22 is oppositely edged for use in cutting a shell free of the shellfish in either edge direction.

The first embodiment in use is grasped by the handle with free point 16 extending downwardly and forwardly. Handle 10 is thrust forward in the common line of forearm, wrist and hand and lower portion 22 to easily penetrate point 16 between bivalve shells. Handle 10 is rotated from side to side around said common line utilizing leverage of linear displacement 28 to open bivalve shells for further insertion of lower portion 22 to cut said shellfish free of its shells.

Figure 4:
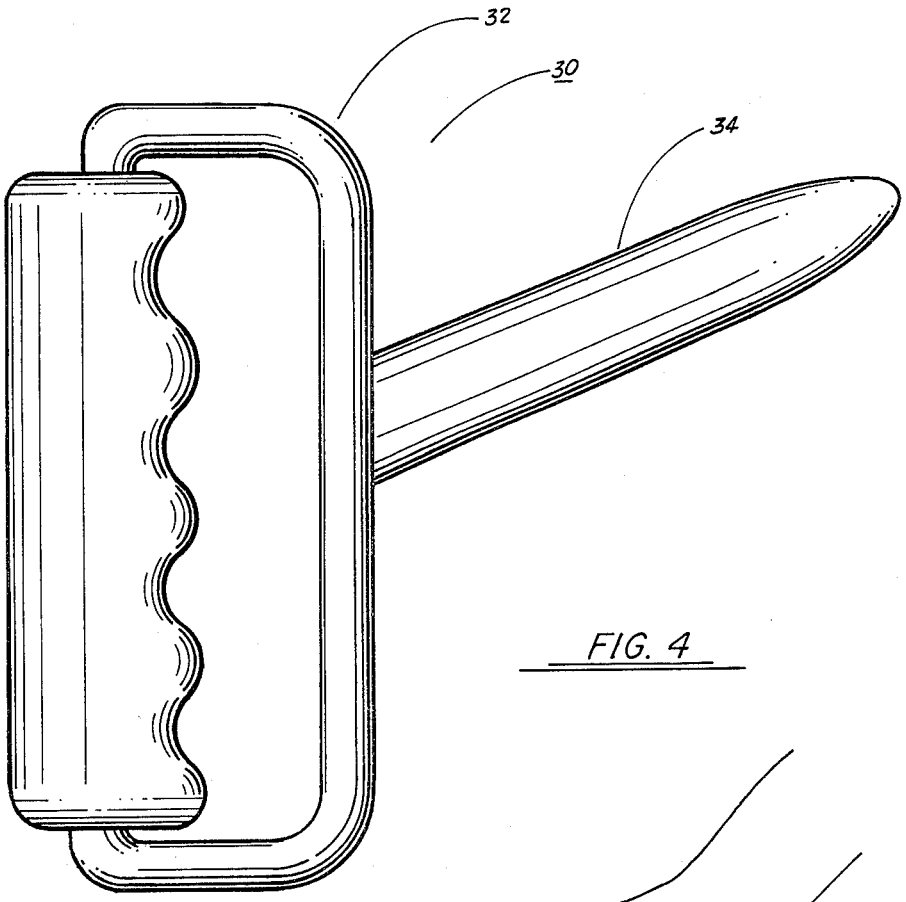
FIG. 4 is a side elevation of said second embodiment of the invention.
Figure 3:
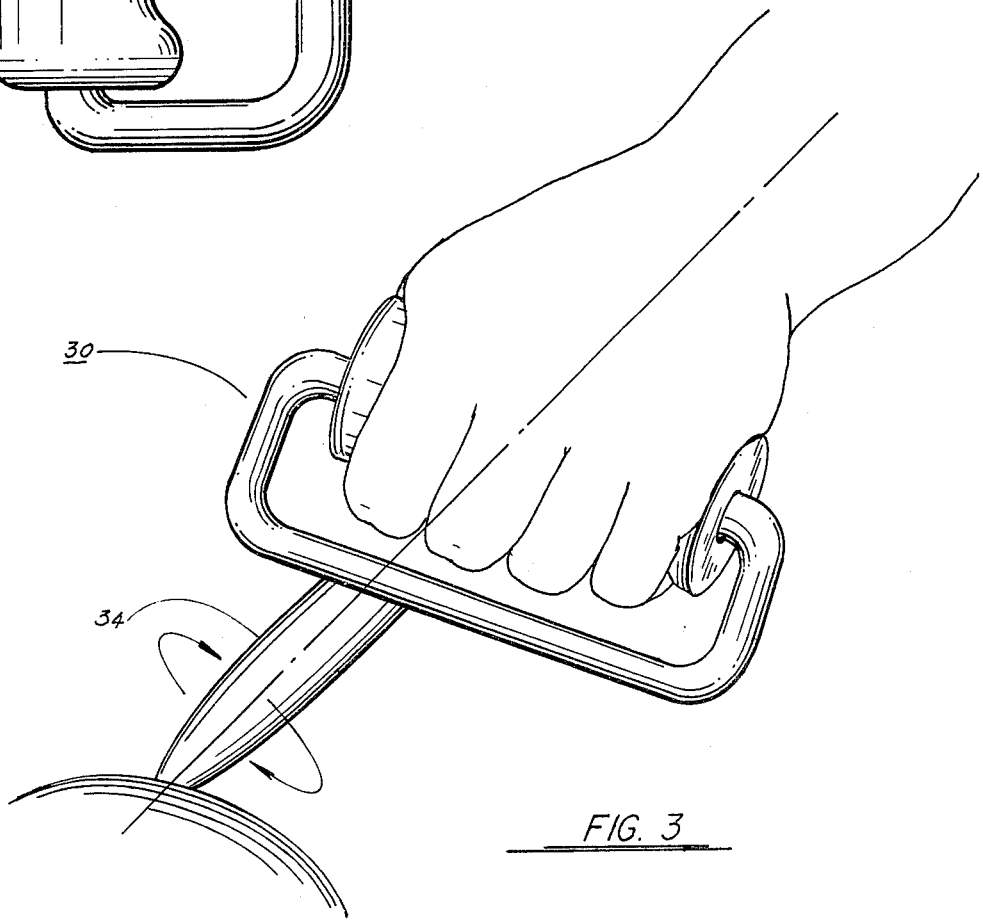
FIG. 3 is a side elevation of a second embodiment of the invention in use.

Referring to FIGS. 3 and 4, the second embodiment of the invention comprises a vertically held knife handle 29 rigidly fixed by oppositely disposed ends to a roughly "U" shaped frame 30, a base 32 of which is offset from and parallel to handle 29. A pointed double-edge blade 34, similar to lower portion 22 of the first embodiment, is rigidly fixed to frame base 32 so that the blade, frame and handle lie in the same plane. Blade 34 is angled to base 32 in alignment with and extension of an operating forearm, the hand of which grasps handle 29 with fingers passing between said handle and offset base 32. The length of handle 29 is a measure of leverage advantage in opening bivalve shellfish by rotating said handle from side to side around the axis of common alignment of blade and forearm.

In both embodiments, the alignment of forearm and opening lower portion or blade ensures that the insertion force applied between half shells has no cross components to tire an operator and raise friction blisters on his hand during extended use of the opening knife.

What is claimed is:

1. A bivalve shellfish opening knife comprising:
   (a) an elongated handle means having oppositely disposed ends for hand grasping therebetween;
   (b) a straight blade means extending downwardly and forwardly, and having a free pointed end for forced insertion between said shellfish bivalve shells by, and in line with, a user's operating forearm, wrist and hand, and having oppositely disposed and spaced apart sharp edges that in side to side rotation is for opening said bivalve shells, and in forward and rearward motion for cutting said shellfish free from said shells; and
   (c) connecting means integral with said blade means for fixing said blade means to said handle means, with said blade means being linearly offset forward from said handle means and aligned with said user's operating forearm, wrist and hand, and with both offset and alignment being in a common vertical plane for the linear application of all insertion force to penetrate between said shells of said shellfish, and for the increased leverage and efficiency resulting therefrom.

2. Bivalve shellfish opening knife as described in claim 1 wherein a first embodiment comprises:
   (a) a horizontally extending handle having finger indentations defined in the lower half thereof;
   (b) connecting means defining with said integral blade means an inverted "Z" shape in which said connecting means is an upper portion and an intermediate portion of said inverted "Z", said upper portion being fixed in a forward end of said horizontally extending handle means to extend forwardly in continuation thereof, and said intermediate portion being fixed to the forward end of said upper portion to extend rearwardly and downwardly therefrom, and said integral blade means is a lower portion fixed to the lower end of said intermediate portion to extend forwardly and downwardly in said arm alignment and linear offset.

3. Bivalve shellfish opening knife as described in claim 1 wherein a second embodiment comprises:

(a) a vertically extending handle having finger indentations in the forward half thereof:

(b) connecting means integral with said blade means defining a recumbant roughly shaped "U", in which the arms of said "U" extend rearwardly and are respectively fixed to oppositely disposed ends of said vertically extending handle means to project normal thereto, and the base of said "U" extending parallel with said handle means and with said integral blade means extending forwardly and upwardly in said arm alignment and linear offset.

* * * * *